US010325715B2

(12) United States Patent
Knoll et al.

(10) Patent No.: US 10,325,715 B2
(45) Date of Patent: Jun. 18, 2019

(54) LOW PROFILE ELECTROMAGNETIC COMPONENT

(71) Applicant: EATON INTELLIGENT POWER LIMITED, Dublin (IE)

(72) Inventors: Clarita Chiting Knoll, San Leandro, CA (US); Zhuomin Liu, Dublin, CA (US); Ramdev Kanapady, Campbell, CA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 89 days.

(21) Appl. No.: 15/286,705

(22) Filed: Oct. 6, 2016

(65) Prior Publication Data

US 2018/0102210 A1 Apr. 12, 2018

(51) Int. Cl.
*H01F 27/29* (2006.01)
*H01F 27/28* (2006.01)
*H01F 27/26* (2006.01)

(52) U.S. Cl.
CPC ..... *H01F 27/2852* (2013.01); *H01F 27/266* (2013.01); *H01F 27/292* (2013.01)

(58) Field of Classification Search
CPC ..... H01F 27/2852
USPC ..... 336/192
See application file for complete search history.

(56) References Cited

U.S. PATENT DOCUMENTS

| | | | | |
|---|---|---|---|---|
| 8,310,332 | B2 | 11/2012 | Yan et al. | |
| 9,202,617 | B2 | 12/2015 | Zhou et al. | |
| 9,275,787 | B2 | 3/2016 | Yan et al. | |
| 2004/0017276 | A1* | 1/2004 | Chen | H01F 17/04 336/192 |
| 2015/0170820 | A1* | 6/2015 | Kadir | H01F 27/292 336/178 |

OTHER PUBLICATIONS

English translation of CN204680522.*

* cited by examiner

*Primary Examiner* — Ronald Hinson
(74) *Attorney, Agent, or Firm* — Armstrong Teasdale LLP

(57) ABSTRACT

A low profile electromagnetic component assembly for a circuit board such as a power inductor includes a first shaped magnetic core piece comprising a bottom surface for seating upon the circuit board, a top surface opposing the bottom surface, and a groove defined on the top surface. A conductive coil winding includes first and second terminal sections and a center main winding section extending between the first and second terminal sections. The center main winding section comprises an elongated strip of conductor having a thickness oriented extend to perpendicular to a plane of the circuit board. The terminal sections define a different cross sectional area of conductor than in the center main winding section.

19 Claims, 6 Drawing Sheets

LOW PROFILE ELECTROMAGNETIC COMPONENT

BACKGROUND OF THE INVENTION

The field of the invention relates generally to electromagnetic components such as inductors, and more particularly to miniaturized, surface mount power inductor components for circuit board applications.

Power inductors are used in power supply management applications and power management circuitry on circuit boards for powering a host of electronic devices, including but not necessarily limited to hand held electronic devices. Power inductors are designed to induce magnetic fields via current flowing through one or more conductive windings, and store energy via the generation of magnetic fields in magnetic cores associated with the windings. Power inductors also return the stored energy to the associated electrical circuit as the current through the winding and may, for example, provide regulated power from rapidly switching power supplies.

Recent trends to produce increasingly powerful, yet smaller electronic devices have led to numerous challenges to the electronics industry. Electronic devices such as smart phones, personal digital assistant (PDA) devices, entertainment devices, and portable computer devices, to name a few, are now widely owned and operated by a large, and growing, population of users. Such devices include an impressive, and rapidly expanding, array of features allowing such devices to interconnect with a plurality of communication networks, including but not limited to the Internet, as well as other electronic devices. Rapid information exchange using wireless communication platforms is possible using such devices, and such devices have become very convenient and popular to business and personal users alike.

For surface mount component manufacturers for circuit board applications required by such electronic devices, the challenge has been to provide increasingly miniaturized components so as to minimize the area occupied on a circuit board by the component (sometimes referred to as the component "footprint") and also its height measured in a direction parallel to a plane of the circuit board (sometimes referred to as the component "profile"). By decreasing the footprint and profile, the size of the circuit board assemblies for electronic devices can be reduced and/or the component density on the circuit board(s) can be increased, which allows for reductions in size of the electronic device itself or increased capabilities of a device with comparable size. Miniaturizing electronic components in a cost effective manner has introduced a number of practical challenges to electronic component manufacturers in a highly competitive marketplace. Because of the high volume of components needed for electronic devices in great demand, cost reduction in fabricating components has been of great practical interest to electronic component manufacturers.

In order to meet increasing demand for electronic devices, especially hand held devices, each generation of electronic devices need to be not only smaller, but offer increased functional features and capabilities. As a result, the electronic devices must be increasingly powerful devices. For some types of components, such as magnetic components that provide energy storage and regulation capabilities, meeting increased power demands while continuing to reduce the size of components that are already quite small, has proven challenging.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

DETAILED DESCRIPTION OF THE INVENTION

Exemplary embodiments of inventive electromagnetic component assemblies and constructions are described below for higher current and power applications having lower profiles while offering comparable performance to existing electromagnetic components having much larger profiles on a circuit board. Electromagnetic components and devices such as power inductors components may also be fabricated with reduced cost compared to other known miniaturized power inductor constructions. Manufacturing methodology and steps associated with the devices described are in part apparent and in part specifically described below but are believed to be well within the purview of those in the art without further explanation.

Figure 12:
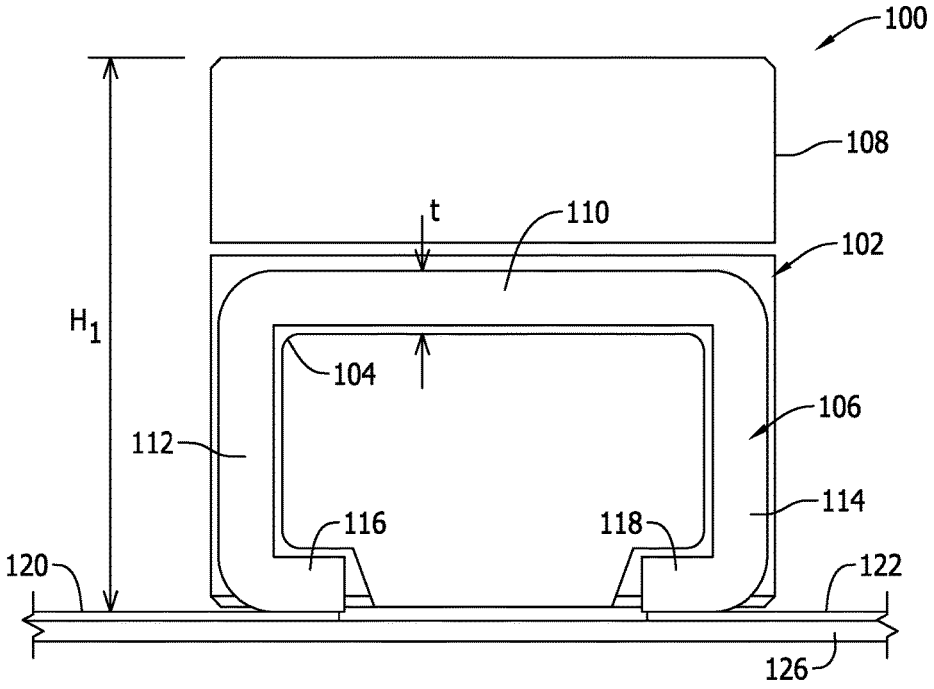
FIG. 12 is a sectional view of a known surface mount, power inductor component.

FIG. 12 illustrates a known construction in sectional view of an electromagnetic component 100, and more specifically a power inductor component that performs acceptably in its magnetic and electrical characteristics in an electrical power system. In the example shown in FIG. 12, the inductor component 100 includes a first magnetic core piece 102 including a U-shaped groove 104 that receives a single turn, C-shaped conductive winding clip 106 and a second magnetic core piece 108 that is assembled with the first core piece 102. By virtue of the shape of the first magnetic core piece 102 it is sometimes referred to by those in the art as a U-core, and by virtue of the shape of the second magnetic core piece 108 it is sometimes referred to by those in the art as an I-core. The I-core 108 may be gapped from the U-core 102 as shown, and in combination the core pieces 102 and 108 produce a low profile height $H_1$ that is realized at least in part because of the construction of the conductive winding clip 106.

The conductive winding clip 106 includes as shown a planar center main winding section 110 that extends as a straight line across the core piece 102, first and second legs 112, 114 and surface mount terminal sections 116, 118 depending from each respective leg 112, 114. The legs 112, 114 extend perpendicularly to a plane of the planar main winding section 110, and the surface mount terminal sections 116, 118 extend perpendicularly from the respective legs 112, 114. As such, the planar main winding section 110 extends horizontally in the winding clip 106 and the surface mount terminal sections 116, 118 also extend horizontally parallel to the main winding section 110. When the surface mount terminal sections 116, 118 are mounted to circuit traces 120, 122 on a circuit board 126, the main winding section 110 and the surface mount terminal sections 116, 118 also extend parallel to the plane of the circuit board 126. The legs 112, 114, however, extend perpendicular to the plane of the circuit board 126 as well as the planar main winding section 110 and the surface mount terminal section 116, 118 of the winding clip 106. The general orthogonal arrangement of the sections 110, 112, 114, 116 and 118 imparts a C-shaped appearance to the winding clip 106.

The winding clip 106 may be fabricated from a freestanding, elongated strip of conductive material that is shaped into the C-shaped winding clip 106 as shown in the sectional view of FIG. 12. The elongated strip of conductive material has a thickness dimension t, a width dimension w that is much larger than the thickness dimension t, and a length dimension equal to the combined axial length of the sections 110, 112, 114, 116 and 118. In the winding clip 106, the thickness of the conductor in the center main winding section 110 is oriented to extend vertically or perpendicularly to the plane of the circuit board 126. The proportions of the elongated strip of conductive material used to make the winding clip 106, as well as the smaller proportions of the axial length of the legs 112, 114 relative to the axial length of the main winding section 110, a low profile winding clip 106 facilitates the low profile height $H_1$ of the component 100 as well as facilitates an efficient power inductor capable of handling higher current with acceptable direct current resistance (DCR) performance and saturation current relative to other types of inductor components having alternative types of coil structures.

While the component 100 delivers an increased power capability in a smaller package size than previous electromagnetic components, still further reduction in the low profile height $H_1$ is desired for state of the art electronic devices, but while otherwise offering comparable performance to the inductor component 100. More specifically, a reduction in the low profile height $H_1$ of the component 100 of about 50% is desired. While such 50% reduction in the low profile height $H_1$ may be accomplished following the design concept shown and described, it requires a much longer length of the elongated conductive strip used to make winding clip 106 in order to keep the saturation current of the component about the same. Specifically, if the low profile height $H_1$ is reduced by ½ the elongated strip to make the winding clip 106 must double in length to provide the same high current capability as before. However, doubling length of the conductor in the winding clip of the component undesirably increases DCR to about twice that of the component 100. Doubling the length of the conductor in the winding clip 106 would also greatly expand the footprint of the component. Another solution is therefore needed.

Exemplary embodiments of electromagnetic component constructions are described herein below that facilitate a significant reduction in the low profile height $H_1$ of the component 100 by 50% without while maintaining the footprint of the component 100, while maintaining the same saturation current of the winding clip 106, and while offering comparable DCR in operation relative to the component 100. This is accomplished at least in part with two or more series connected conductors in the coil winding structure, one of which has a reduced cross sectional area relative to the other such that DCR can be maintained. Lower profile magnetic core pieces are shaped to receive the two or more series connected conductors, such that the low profile height of the completed component can therefore be reduced without significantly increasing the length and width of the component (i.e., the component footprint) relative to the component 100.

Figure 1:
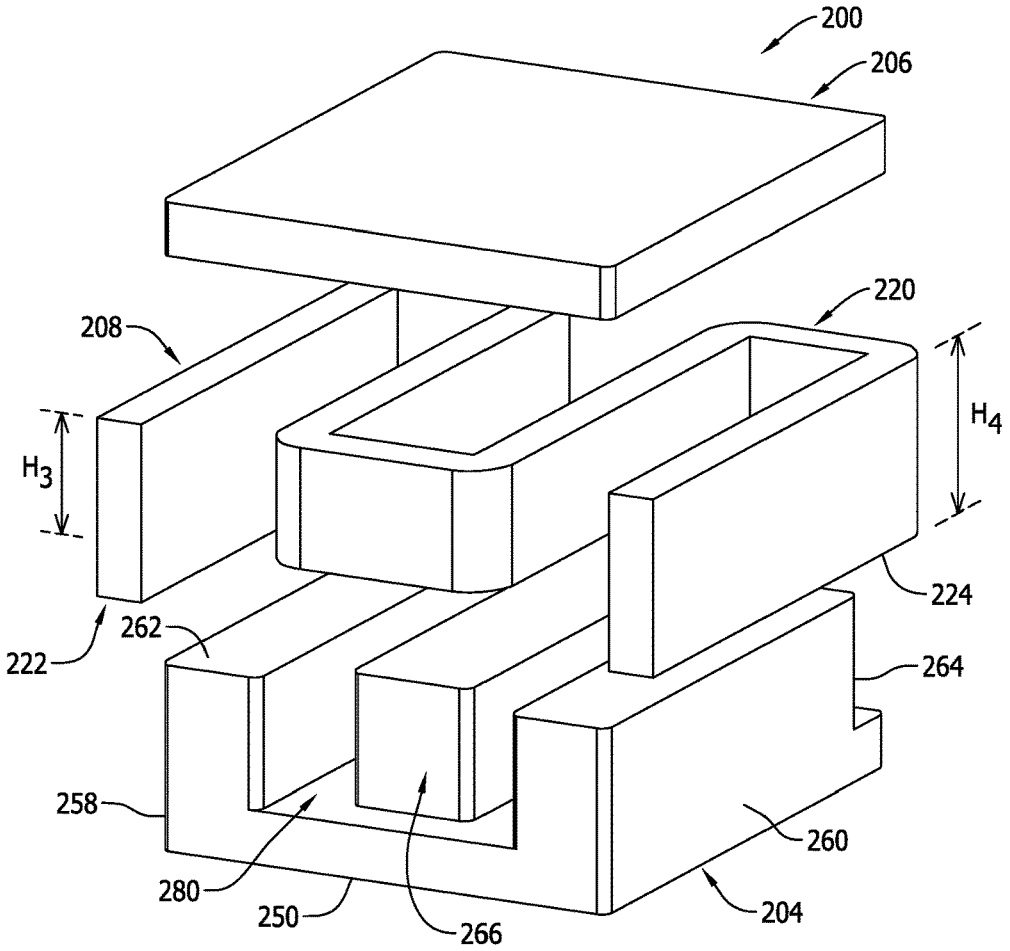
FIG. 1 is an exploded view of an exemplary electromagnetic surface mount, power inductor component shown in FIG. 1.
Figure 6:
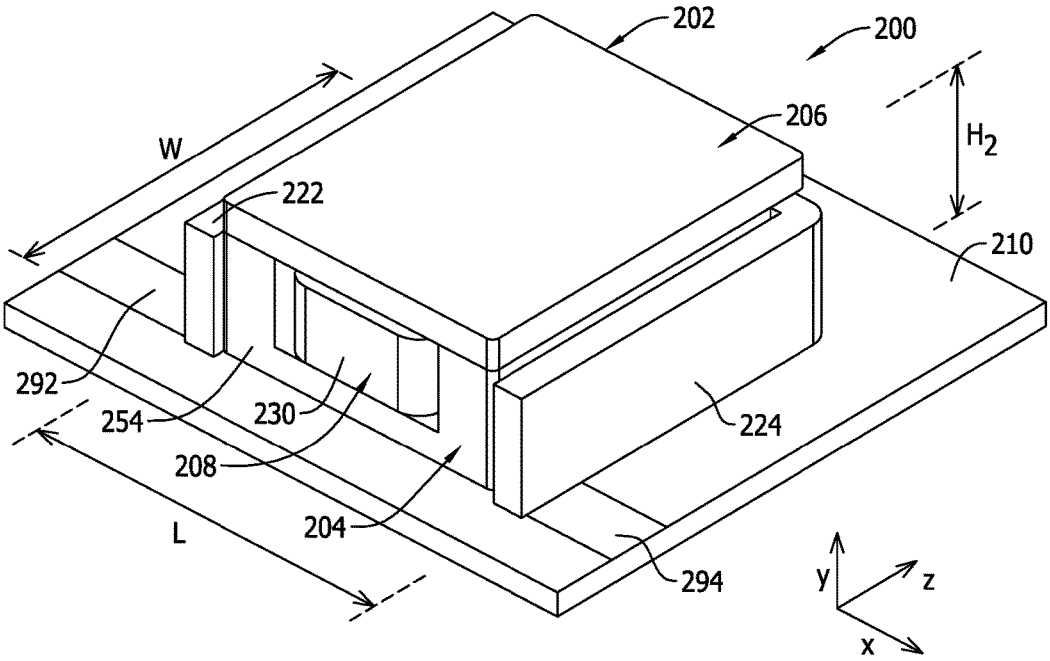
FIG. 6 is an assembled view of the surface mount, power inductor component shown in FIG. 1.

FIG. 1 is a top perspective view of a first exemplary embodiment of a surface mount, electromagnetic component 200 and FIG. 6 is a completed view of the component 200 that advantageously achieves the benefits described above. As described below, the component 200 is configured as a power inductor component, although other types of electromagnetic components may benefit from the teachings described below, including but not limited to inductor components other than power inductors, and also including transformer components.

As shown in FIGS. 1 and 6, the component 200 generally includes a magnetic core 202 defined by a first core piece 204 and a second core piece 206. A conductive coil winding 208 is contained in the first core piece 206 and is covered by the second magnetic core piece 206. In combination, the core pieces 204, 206 and coil winding 208 impart on overall length L of the magnetic core 202 along a first dimension such as an x axis of a Cartesian coordinate system. Each core piece 204, 206 also has a width W measured along a second dimension perpendicular to the first axis such as a y axis of a Cartesian coordinate system, and a low profile height $H_2$ measured along a third dimension perpendicular to the first and second axis such as a z axis of a Cartesian coordinate system. In the example of FIGS. 1 and 6, the dimensions L and W are much greater than the dimension $H_2$, such that when the component 200 is surface mounted on a circuit board 210 in the x, y plane the component 200 has a small height dimension $H_2$ along the z axis facilitating use of the circuit board 210 to provide a slim electronic device. Relative to the component 100, (FIG. 12) the dimensions L and W of the component 200 are about the same as the corresponding dimensions of the component 100, while the height dimension $H_2$ of the component 100 is about ½ the height dimension $H_1$ of the component 100. In the x, y plane the length L and width W of the core 202 formed by the combination of the core pieces 204, 206 allows the component to capably handle higher current, higher power applications commensurate with the component 100 but beyond the limits of more conventional electromagnetic component constructions having a comparable low profile height $H_2$.

The coil winding 208 (FIGS. 1-3) includes a center main winding section 220 and terminal sections 222, 224 on either side of the center main winding section 220. The terminal sections 222, 224 are connected in series with the center main winding section 220. The center section 220 is fabricated from a first freestanding, elongated strip of conductive material having a first height dimension $H_3$ and each of the terminal sections 222, 224 are fabricated from an elongated strip of conductive material having a second height dimension $H_4$ that is greater than the first height dimension $H_3$. The conductor material of the center section 220 and terminal sections 222, 224 have approximately the same thickness $t_1$ in the example shown, although they may each have a different thickness in an another embodiment as desired. The increased height dimension $H_4$ of the terminal sections 222, 224 provides a larger cross sectional area of the conductor in the terminal sections 222, 224 and a smaller cross sectional area in the center section such that DCR is maintained at the desired level. The increased height dimension $H_4$ of the terminal sections 222, 224 further allows the terminal sections 224, 226 to reach the circuit board 210 in the completed component for surface mounting while the center main winding section 220 is elevated from the board 210 on the first magnetic core piece 204. As seen in the example of FIGS. 1 and 3, a top edge of the conductor in the center main winding section 220 and a top edge of the terminal sections 222, 224 are coplanar, while the bottom edge of the conductor in the terminal sections 224, 224 are parallel to but spaced from the bottom edge of the center main winding section 220.

Relative to the coil winding clip 106 in the component 100, the center main winding section 220 of the coil winding 208 in the component 200 is relatively large in the height dimension as the thickness $t_1$ (FIG. 2) of the conductor used to make the coil winding 208 is oriented to extend in a horizontal direction extending parallel to the circuit board 210. In the component 100 (FIG. 12), the thickness of the center main winding section 110 is oriented to extend vertically or perpendicular to the plane of the circuit board 126. Alternatively stated, the length and width plane of the conductor in the main winding section 110 in the component 100 extends generally parallel to the plane of the circuit board 126, whereas in the center main winding section 220 of the component 200, the length and width planes of the conductor extends perpendicular to the plane of the circuit board 210. The orientation of the conductor thickness $t_1$ in the component 200 contributes to the low profile height $H_2$ of the component 200.

Figure 2:
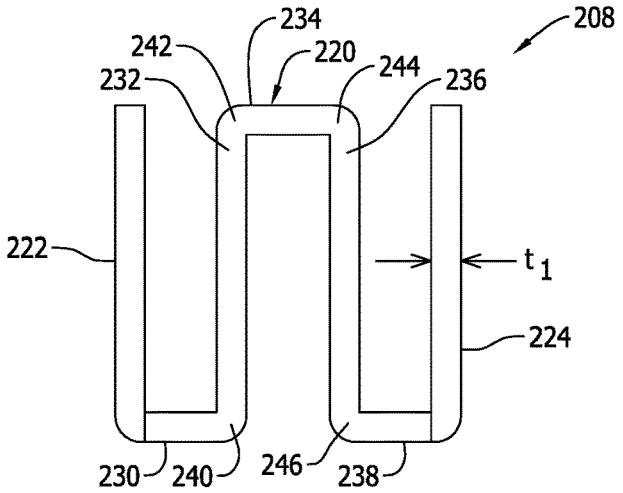
FIG. 2 is an elevational view of the conductive winding for surface mount, power inductor component shown in FIG. 1.
Figure 3:
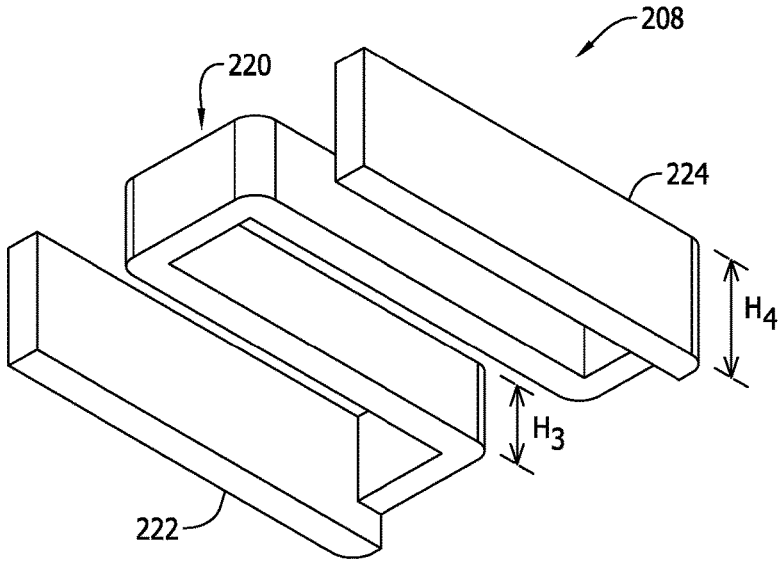
FIG. 3 is a perspective view of the conductive winding shown in FIG. 2.

As best shown in FIG. 2, and unlike the main winding section 110 in the component 100, the center main winding section 220 of the component 200 in the illustrated example includes a series of straight conductor sections 230, 232, 234, 236 and 238. Each adjacent one of the straight conductor sections 230, 232, 234, 236 and 238 is connected by an angular bend 240, 242, 244 and 246. In the example shown, the angular bends 240, 242, 244 and 246 are each right angle, 90° bends. The straight conductor sections 230, 238 are shown to be generally aligned and coplanar to one another to respectively extend a first axial distance from each terminal section 222, 224. The straight conductor sections 232, 236 in the example shown extend in a spaced apart and parallel orientation to one another and perpendicularly to the straight conductor sections 230, 238 for a second axial distance larger than the first axial distance. The straight conductor section 234 extends between and generally perpendicular to the straight conductor sections 232, 236 and parallel to the straight conductor sections 230, 238. The center main winding section 208 in this example is symmetrical and defines a serpentine winding path between the terminal sections 222, 224 that are each provided as straight and flat conductor plates.

The shape and geometry of the center section 220 and the conductor plates 222, 224 provides for an economical manufacture and ease of assembly with the first core piece 204 as further described below. The shape and geometry of the center section 220 may vary, however, in alternative embodiments as desired. That is, the angular bends need not be 90° and curved conductor sections, as opposed to straight conductor sections, may be utilized in alternative embodiments. The conductive winding 208 including the center main winding section 220 and the terminal sections 222, 224 may be pre-formed as a separate stage of manufacture and provided for assembly with the magnetic core pieces 204 and 206.

Figure 4:
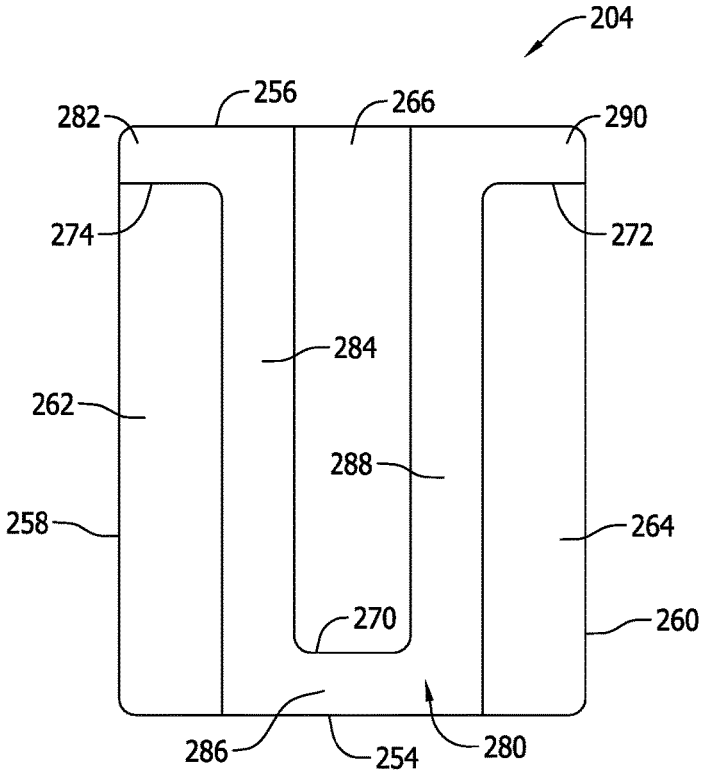
FIG. 4 is a top plan view of a first core piece for the surface mount, power inductor component shown in FIG. 1.
Figure 5:
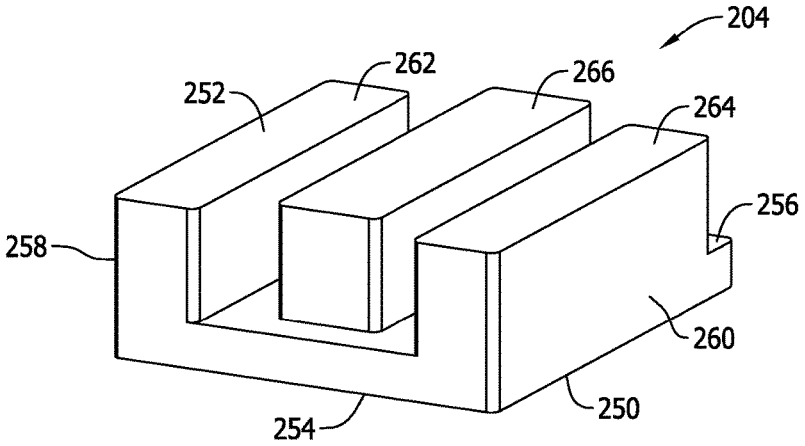
FIG. 5 is a perspective view of the first core piece shown in FIG. 4.

As shown in FIGS. 1, 4 and 5, the first magnetic core piece 204 includes a bottom wall or surface 250, a top wall or surface 252 opposing the bottom wall or surface 250, a first set of opposing lateral walls or surfaces 254 and 256, and a second set of walls or surface 258 and 260. The walls 254, 256 and 258, 260 are orthogonally arranged such that the core piece 204 is generally rectangular in its outer appearance. The top surface 252 in the example shown is defined by longitudinally extending rectangular posts 262, 264 that are spaced apart and extend generally parallel to one another for a distance less than the distance between the lateral side walls 254, 256. In between the rectangular posts 262, 264 is a third rectangular post 266 that extends parallel to the posts 262, 264 for a distance less than the distance between the side walls 254, 256. The post 266 is longitudinally staggered or offset from the posts 262, 264 such that a recess is provided between an end 270 of the post 226 and the side wall 254, and a recess is likewise provided between respective ends 272, 274 of the posts 262, 264 and the side wall 256.

The staggered posts 262, 264, 266 define a groove 280 (FIG. 4) extending therebetween and in the recesses at each end of the posts 262, 264, 266 described above. The groove 280 accordingly includes segments 282, 284, 286, 288 and 290 that dimensionally and geometrically receive the conductor sections of the center main winding section 220 described above as the component 200 is assembled. The core piece 204 may be pre-formed at a separate stage of manufacture and may be provided for assembly with the coil winding 208.

As shown in FIGS. 1 and 6, when the coil winding 208 is assembled to the first core piece 204, the conductor section 230 is exposed in the groove segment 286 on the lateral side wall 254, the terminal sections 222, 224 run alongside the opposed lateral side walls 258, 260 of the core piece 204 for the entire length between the walls 254, 256. Alternative geometry and proportions of the terminal sections 222, 224 may be utilized in another embodiment. Also, in alternative embodiments a conductor section of the center main winding section 220 need not be exposed on an exterior side of the core piece 204.

The assembly of the component 200 is completed by coupling the second magnetic core piece 206 to the core piece 204 after the center main winding section 220 is received in the groove 280 of the core piece 204 with the terminal sections 222, 224 extending exterior to the core piece 204 as shown and described. In the illustrated example, the core piece 206 is a rectangular, flat plate that does not include any grooves, slots or openings and is therefore economically manufactured with a minimal low profile height. The core piece 206, however, could assume an alternative shape in another embodiment. The core piece 206 may be fabricated at a separate stage of manufacture and provided for assembly with the first coil piece 204 and the coil winding 108.

The core pieces 204, 206 may be defined and shaped utilizing soft magnetic particle materials and known techniques such as molding of granular magnetic particles to produce the desired shape. Soft magnetic powder particles used to fabricate the core pieces 204, 206 may include Ferrite particles, Iron (Fe) particles, Sendust (Fe—Si—Al) particles, MPP (Ni—Mo—Fe) particles, HighFlux (Ni—Fe) particles, Megaflux (Fe—Si Alloy) particles, iron-based amorphous powder particles, cobalt-based amorphous powder particles, and other suitable materials known in the art. Combinations of such magnetic powder particle materials may also be utilized if desired. The magnetic powder particles may be obtained using known methods and techniques. The magnetic powder particles may be coated with an insulating material such that the core pieces 204, 206 possess-so called distributed gap properties. The core pieces 204, 206 may also be physically gapped from one another in a known manner.

In the completed component, the terminal sections 222, 224 may be surface mounted to circuit traces 292, 294 on the circuit board 210 using known soldering techniques. The low profile height $H_2$ is about ½ of the low profile height $H_1$ of the component 100 while providing about the same footprint on the board 100 and with similar saturation current and DCR performance characteristics.

Figure 7:
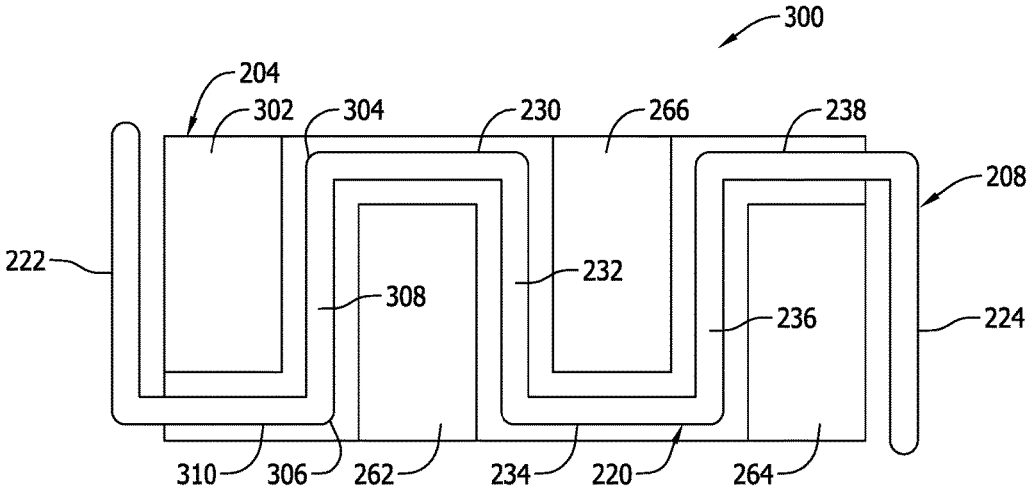
FIG. 7 is a first alternative core piece and conductive winding structure for the inductor component shown in FIG. 1.

FIG. 7 shows a construction of an electromagnetic component 300 that is similar in aspects to the component 200 described above. In the component 300, the core piece 204 is formed with an additional post 302 that is staggered from the posts 262, 264 with the post 266. The center main winding section 220 of the coil winding 208 further includes additional bends 304 and 306 and additional conductor sections 308, 310 extending from the conductor section 230. As such, the serpentine path of the center main winding section 220 in the component 300 is larger than in the component 200. The component 300 is accordingly operable with a higher inductance value than the component 200. Additional conductor segments and bends may be provided in the center main winding section 220 to produce components with still further performance variations to meet a variety of different needs in different power systems, or at different locations in an electrical power system. The core piece 204 in the component 300 is larger than in the component 200 and the component 300 accordingly has a larger footprint on a circuit board, but when completed with an appropriately dimensioned core piece 206 it may have about the same low profile height $H_2$ of the component 200. Additional conductor segments and bends may be provided in the center main winding section 220 to produce components with still further performance variations to meet a variety of different needs in different power systems, or at different locations in an electrical power system. The length of the serpentine path in the center main section 220 is generally scalable to provide more or less inductance as desired.

Figure 8:
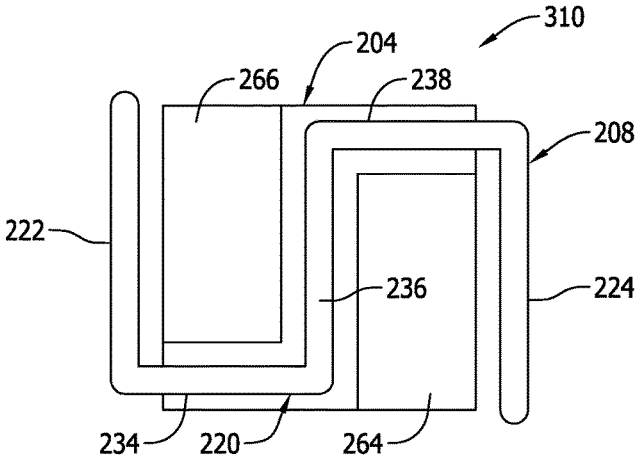
FIG. 8 is a second alternative core piece and conductive winding structure for the inductor component shown in FIG. 1.

FIG. 8 shows another construction of an electromagnetic component 310 that is another adaptation of the component 200. In the component 310, the post 262 is omitted in the core piece 204 such that the core piece 204 only includes the posts 264 and 266 that are offset as described above. The conductor sections 230 and 232 and the bends 240, 242 are also omitted in the center main winding section 220 of the coil winding 208. As such, the serpentine path of the center main winding section 220 in the component 310 is smaller than in the component 200. The component 300 is accordingly operable with a lower inductance value than the component 200. The core piece 204 in the component 300 is smaller than in the component 200 and the component 300 accordingly has a smaller footprint on a circuit board, but when completed with an appropriately dimensioned core piece 206 it may have about the same low profile height $H_2$ of the component 200.

Figure 9:
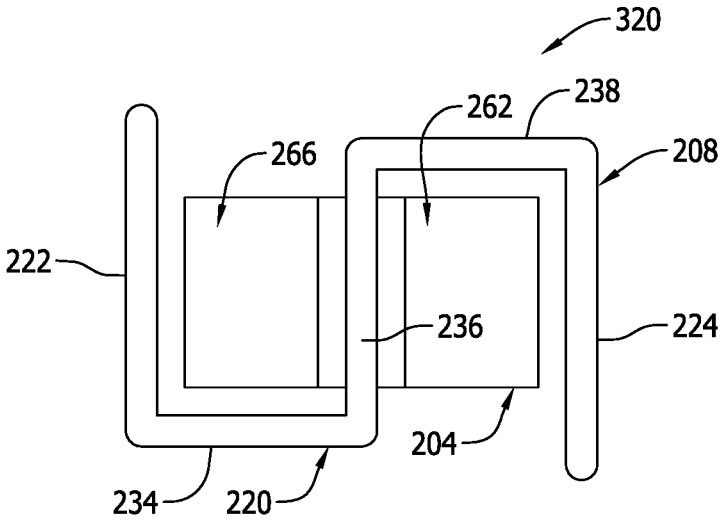
FIG. 9 is a third alternative core piece and conductive winding structure for the inductor component shown in FIG. 1.

FIG. 9 shows another construction of an electromagnetic component 320 that is an adaptation of the component 200. In the component 320, the post 266 is omitted in the core piece 204 and only the posts 262, 264 are provided but with no offset as shown. The conductor sections 230 and 232 and the bends 240, 242 are also omitted in the center main winding section 220 of the coil winding 208. As such, the serpentine path of the center main winding section 220 in the component 320 is smaller than in the component 200. The component 300 is accordingly operable with a lower inductance value than the component 200. The core piece 204 in the component 300 is smaller than in the component 200 and the component 300 accordingly has a smaller footprint on a circuit board, but when completed with an appropriately dimensioned core piece 206 it may have about the same low profile height $H_2$ of the component 200.

Figure 10:
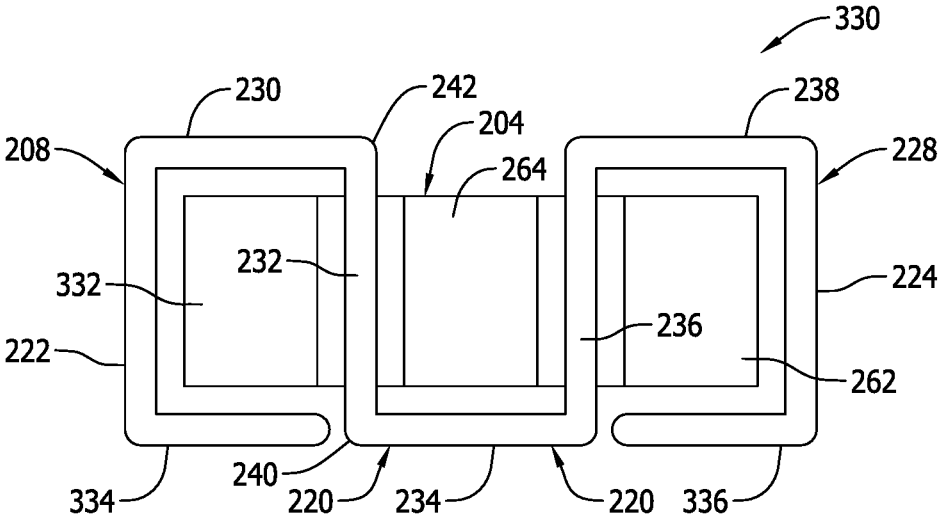
FIG. 10 is a fourth alternative core piece and conductive winding structure for the inductor component shown in FIG. 1.

FIG. 10 shows another construction of an electromagnetic component 330 that is an adaptation of the component 320. In the component 330, a third post 332 is provided with the posts 262, 264 but with no offset as shown. The conductor sections 230 and 232 and the bends 240, 242 are included in the center main winding section 220 of the coil winding 208. As such, the serpentine path of the center main winding section 230 in the component 330 is larger than in the component 320. The component 330 is accordingly operable with a lower inductance than the component 200. The core piece 204 in the component 330 is about the same size as in the component 200 and the component 300 accordingly has about the same footprint on a circuit board. When the component 330 is completed with an appropriately dimensioned core piece 206 it may have about the same low profile height $H_2$ of the component 200. Additional conductor segments and bends may be provided in the center main winding section 220 to produce components with still further performance variations to meet a variety of different needs in different power systems, or at different locations in an electrical power system. The length of the serpentine path in the center main section 220 is generally scalable to provide more or less inductance as desired.

Also in the component 330, additional sections 334, 336 are included in the terminal sections 222, 224 that wrap around the corners of the core piece 204 and extend inwardly toward the conductor section 234 of the center main winding section, but do not connect to the conductor section 234. In this arrangement of the component, the ends of the terminal sections (i.e., the ends of the sections 334, 336) extend on the same side of the core piece as opposed to different sides as in the preceding embodiments.

Figure 11:
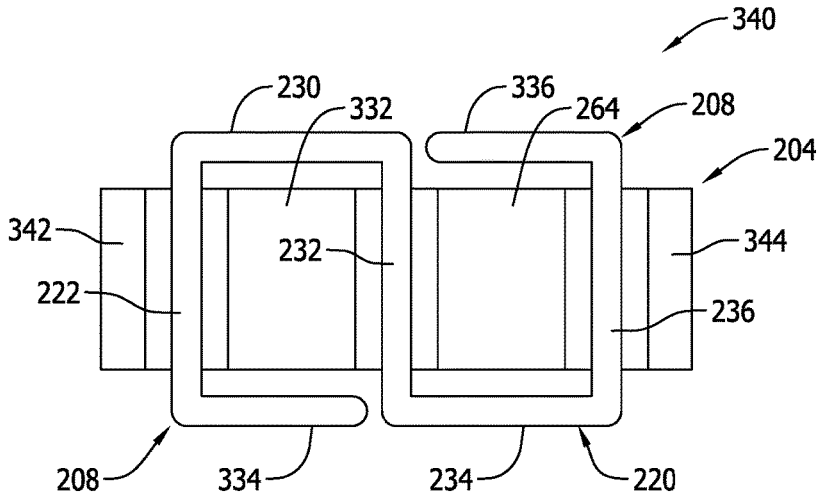
FIG. 11 is a fifth alternative core piece and conductive winding structure for the inductor component shown in FIG. 1.

FIG. 11 shows another construction of an electromagnetic component 340 that is an adaptation of the component 330. The center main winding section includes fewer conductor segments and bends than in the component 330, and the terminal section 336 is now located on an opposite side of the core piece 204 than the terminal section 232. Also, additional posts 342, 344 are provided on the sides of the core piece 204 such that the sections 222, 236 are not exposed on the respective sides of the core piece 204. Groove segments are defined between the side posts 342, 344 and the respective posts 332, 264 that receive the sections 222, 236. Only the tends of the terminal sections (i.e., the ends of the sections 334, 336) extend exterior to the core piece 204. When the component 340 is completed with an appropriately dimensioned core piece 206 it may have about the same low profile height $H_2$ of the component 200.

The benefits and advantages of inventive concepts described are now believed to have been amply illustrated in relation to the exemplary embodiments disclosed.

An embodiment of a low profile electromagnetic component assembly for a circuit board has been disclosed including a first shaped magnetic core piece having a bottom surface for seating upon the circuit board, a top surface opposing the bottom surface, and a groove defined on the top surface. The component assembly also includes a conductive coil winding having first and second terminal sections and a center main winding section extending between the first and second terminal sections. The center main winding section is a freestanding elongated strip of conductor having a thickness oriented to extend parallel to a plane of the circuit board. The conductor includes a first end, a second end, and an axial length between the first and second ends that includes at least one bend. The conductor in the center main winding section has a first low profile height dimension and is received in the groove. The first and second terminal sections each have a second low profile height dimension, with the second low profile height direction being larger than the first low profile height dimension. A second shaped magnetic core piece overlies the first magnetic core piece and the center main winding section.

Optionally, the first shaped magnetic core piece may further include a first lateral side and a second lateral side opposing the first lateral side, and a portion of the center main winding section may be exposed on the first lateral side. The first lateral side may include at least one recess, and the exposed portion of the center section may extend in the at least one recess. The first magnetic core piece may also include a third lateral side and a fourth lateral side opposing the third lateral side between the top and bottom surfaces, and the first and second terminal sections may extend along the third and fourth lateral sides. The first and second terminal sections may extend along an entirety of the third and fourth lateral sides.

As another option, at least a portion of the first and second terminal sections may extend along one of the first and second lateral sides. The first terminal section may extend on the first lateral side and the second terminal section may extend on the second lateral side.

The center main winding section may include a series of conductor sections defining a symmetrical shape. The conductor of the center main winding section may define at least a portion of a serpentine path including at least two bends between the first and second ends. The conductor of the center main winding section may also define a serpentine path including at least four bends between the first and second ends.

The center main winding section may include a plurality of straight conductor sections interconnected by the at least one bend. The at least one bend may be a 90° bend. The at least one bend may include a plurality of 90° bends.

The first shaped magnetic core piece may include a first post and a second post on the top surface, and the groove may be at least partly defined between the first post and the second post. The first shaped magnetic core piece may also include a third post on the top surface, the third post being staggered from the first post and second post, and the groove being a serpentine groove extending at least partly between the first, second and third posts.

The first magnetic core piece may include at least one additional side post on the top surface, and a groove extending between the at least one additional side post and at least one of the first post and the second post.

The first shaped magnetic core piece may have a length dimension and a width dimension on the bottom surface, and the height dimension of the first shaped magnetic core piece may be less that the length dimension and the width dimension. The second shaped magnetic core piece may be a flat piece. The second shaped magnetic core piece may have a low profile height dimension that is less than a low profile height dimension of the first shaped magnetic core piece. The component may be a power inductor component.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A low profile electromagnetic component assembly for a circuit board comprising:

a first shaped magnetic core piece comprising a bottom surface for seating upon the circuit board, a top surface opposing the bottom surface, and a groove defined on the top surface; a conductive coil winding comprising first and second terminal sections and a center main winding section extending between the first and second terminal sections;

wherein the center main winding section and the first and second terminal sections comprise a freestanding elongated strip of conductor having a thickness oriented to extend parallel to a plane of the circuit board; wherein the conductor includes a first end, a second end, and an axial length between the first and second ends that includes at least one bend; wherein the conductor in the center main winding section has a first low profile height dimension and is received in the groove; wherein the conductor in the first and second terminal sections each have a second low profile height dimension, the second low profile height dimension being larger than the first low profile height dimension; and a second shaped magnetic core piece overlying the first shaped magnetic core piece and the center main winding section; wherein the first shaped magnetic core piece further comprises a first lateral side and a second lateral side opposing the first lateral side, and wherein at least a portion of the first and second terminal sections extend along one of the first and second lateral sides.

2. The electromagnetic component assembly of claim 1, wherein the first terminal section extends on the first lateral side and the second terminal section extends on the second lateral side.

3. The electromagnetic component assembly of claim 1, wherein the center main winding section includes a series of conductor sections defining a symmetrical shape.

4. The electromagnetic component assembly of claim 1, wherein the first shaped magnetic core piece further has a length dimension and a width dimension on the bottom surface, and wherein the height dimension of the first shaped magnetic core piece is less that the length dimension and the width dimension.

5. The electromagnetic component assembly of claim 1, wherein the second shaped magnetic core piece is a flat piece.

6. The electromagnetic component assembly of claim 1, wherein the second shaped magnetic core piece has a low profile height dimension that is less than a low profile height dimension of the first shaped magnetic core piece.

7. The electromagnetic component assembly of claim 1, wherein the electromagnetic component assembly is configured as a power inductor component.

8. The electromagnetic component assembly of claim 1, wherein the first shaped magnetic core piece further comprises a third lateral side and a fourth lateral side opposing the third lateral side, and wherein a portion of the center main winding section is exposed on the third lateral side.

9. The electromagnetic component assembly of claim 8, wherein the third lateral side includes at least one recess, and wherein the exposed portion of the center section extends in the at least one recess.

10. The electromagnetic component assembly of claim 8, wherein the first and second terminal sections extend along each of the first and second lateral sides.

11. The electromagnetic component assembly of claim 10, wherein the first and second terminal sections extend along an entirety of the first and second lateral sides.

12. The electromagnetic component assembly of claim 1, wherein the conductor of the center main winding section defines at least a portion of a serpentine path including at least two bends between the first and second ends.

13. electromagnetic component assembly of claim 12, wherein the conductor of the center main winding section defines a serpentine path including at least four bends between the first and second ends.

14. The electromagnetic component assembly of claim 1, wherein the center main winding section comprises a plurality of straight conductor sections interconnected by the at least one bend.

15. The electromagnetic component assembly of claim 14, wherein the at least one bend is a 90° bend.

16. The electromagnetic component assembly of claim 15, wherein the at least one bend includes a plurality of 90° bends.

17. The electromagnetic component assembly of claim 1, wherein the first shaped magnetic core piece comprises a first post and a second post on the top surface, and wherein the groove is at least partly defined between the first post and the second post.

18. The electromagnetic component assembly of claim 17, wherein the first shaped magnetic core piece includes a third post on the top surface, the third post being staggered from the first post and second post, and the groove being a serpentine groove extending at least partly between the first, second and third posts.

19. The electromagnetic component assembly of claim 17, wherein the first shaped magnetic core piece further comprises at least one additional side post on the top surface, and a groove extending between the at least one additional side post and at least one of the first post and the second post.

* * * * *